US010619527B2

(12) United States Patent
Bogdanski

(10) Patent No.: US 10,619,527 B2
(45) Date of Patent: Apr. 14, 2020

(54) VARIABLE VALVE TRAIN

(71) Applicant: MAN Truck & Bus AG, München (DE)

(72) Inventor: Peter Bogdanski, Schwabach (DE)

(73) Assignee: MAN TRUCK & BUS AG, München (DE)

( * ) Notice: Subject to any disclaimer, the term of this patent is extended or adjusted under 35 U.S.C. 154(b) by 0 days.

(21) Appl. No.: 16/111,825

(22) Filed: Aug. 24, 2018

(65) Prior Publication Data

US 2019/0063272 A1 Feb. 28, 2019

(30) Foreign Application Priority Data

Aug. 24, 2017 (DE) ..... 10 2017 119 348

(51) Int. Cl.
*F01L 13/00* (2006.01)
*F01L 1/18* (2006.01)
*F01L 1/26* (2006.01)

(52) U.S. Cl.
CPC ..... *F01L 13/0063* (2013.01); *F01L 1/181* (2013.01); *F01L 1/267* (2013.01); *F01L 2105/00* (2013.01); *F01L 2820/032* (2013.01)

(58) Field of Classification Search
CPC . F01L 1/053; F01L 1/181; F01L 1/267; F01L 1/46; F01L 1/344; F01L 13/0005; F01L 13/0063; F01L 2105/00
USPC ..... 123/90.16, 90.2, 90.27, 90.39, 90.44
See application file for complete search history.

(56) References Cited

U.S. PATENT DOCUMENTS 5,899,180 A * 5/1999 Fischer ..... F01L 1/181 123/90.16
6,357,405 B1 * 3/2002 Tsuji ..... F01L 1/053 123/90.16
2005/0126526 A1 * 6/2005 Fujita ..... F01L 1/08 123/90.16
2005/0150472 A1 7/2005 Fujii et al.
2007/0095311 A1 * 5/2007 Tateno ..... F01L 1/267 123/90.16
2009/0151674 A1 6/2009 Park et al.
2009/0288622 A1 * 11/2009 Kwon ..... F01L 13/0026 123/90.16

(Continued)

FOREIGN PATENT DOCUMENTS

DE 4220816 A1 1/1994
DE 102004040652 A1 2/2006

(Continued)

*Primary Examiner* — Jorge L Leon, Jr.
(74) *Attorney, Agent, or Firm* — Weber Rosselli & Cannon LLP

(57) ABSTRACT

The present disclosure relates to a variable valve train for an internal combustion engine. The variable valve train has a camshaft with a cam and a rocker arm for activating at least one gas exchange valve of the internal combustion engine. The variable valve train has a swivelling lever element, in particular a swivelling lever gate, which has a support surface and a cam follower. The support surface is operatively connected, in particular in contact, with the rocker arm, and the cam follower follows a cam contour of the cam. The variable valve train has a first lever arm, which pivotably mounts the swivelling lever element, and is connected with a driven swivelling shaft for swivelling around a longitudinal axis of the swivelling shaft.

21 Claims, 3 Drawing Sheets

(56) References Cited

U.S. PATENT DOCUMENTS

| | | | | |
|---|---|---|---|---|
| 2009/0288623 | A1* | 11/2009 | Lee | F01L 13/0026 123/90.16 |
| 2010/0018484 | A1* | 1/2010 | Choi | F01L 13/0026 123/90.16 |
| 2010/0059005 | A1* | 3/2010 | Stone | F01L 13/0063 123/90.16 |
| 2011/0120398 | A1* | 5/2011 | Nakamura | F01L 1/267 123/90.15 |
| 2014/0182528 | A1* | 7/2014 | Jeon | F01L 1/181 123/90.12 |
| 2014/0299082 | A1* | 10/2014 | Kim | F01L 13/0015 123/90.15 |
| 2015/0059673 | A1* | 3/2015 | Hwang | F01L 1/185 123/90.16 |
| 2016/0169124 | A1* | 6/2016 | Hioka | F02D 13/0207 123/90.16 |

FOREIGN PATENT DOCUMENTS

| | | | |
|---|---|---|---|
| EP | 0717174 | A1 | 6/1996 |
| FR | 2357731 | A1 | 2/1978 |
| JP | S5591714 | A | 7/1980 |
| JP | H0610633 | A | 1/1994 |
| JP | 2005233006 | A | 9/2005 |
| JP | 2007218266 | A | 8/2007 |
| WO | 2015093290 | A1 | 6/2015 |

* cited by examiner

VARIABLE VALVE TRAIN

BACKGROUND

The present disclosure relates to a variable valve train for an internal combustion engine.

It is generally known to use variable valve trains for changing the switching times and valve lifts of gas exchange valves of an internal combustion engine during operation of the internal combustion engine. A plurality of variable valve trains are known.

US 2005/0150472 A 1 discloses an example of a variable valve train. The variable valve train has a camshaft, which is rotatably mounted on a fixed part of the engine and comprises a cam. A first rocker arm is pivotably mounted on a fixed part of the engine. The first rocker arm engages a shaft of an engine valve. A rotatable drum is carried by a fixed part of the engine, and at least partially envelops the cam. A second rocker arm is pivotably mounted on the drum. A control element is provided for turning the drum. The second rocker arm has a cam follower, which follows the cam of the camshaft. The first rocker arm has a roller in contact with a bearing surface of the second rocker arm.

The disadvantage to known variable valve trains, such as the variable valve train from US 2005/0150472 A1, is that the latter often have a complicated structural design, a large number of parts and/or a large installation space.

Therefore, the object of the present disclosure is to create an improved variable valve train with which the disadvantages in the prior art can be overcome. In particular, the variable valve train is to have a simple structural design, few parts and/or only a small installation space.

SUMMARY

The variable valve train is suitable for an internal combustion engine. The variable valve train has a camshaft with a cam. The variable valve train has a rocker arm for activating at least one gas exchange valve of the internal combustion engine. The variable valve train has a swivelling lever element, in particular a swivelling lever gate, which has a support surface and a cam follower. The support surface is operatively connected, in particular in contact, with the rocker arm, and the cam follower follows a cam contour of the cam. The variable valve train has a first rocker arm, which pivotably mounts the swivelling lever element, and is connected with a driven swivelling shaft for swivelling around a longitudinal axis of the swivelling shaft.

The variable valve train enables a variable transmission of the cam contour to the rocker arm by changing a position of a swivelling axis, which pivotably connects the swivelling lever element with the first lever arm. Specifically, displacing the lever arm with the swivelling shaft changes the position of the swivelling axis, which leads to a displacement motion of the swivelling lever element. The contact positions between the rocker arm, swivelling lever element and cam change in the process. The altered contact positions can be used to realize various "transmissions" of the cam contour onto the rocker arm via the swivelling lever element, and thus influence the height of the maximum valve lift.

In order to ensure the variability of the valve train, only a few additional parts are required in relation to a non-variable valve train. These include in particular the first lever arm and the swivelling lever element. The comparatively simple construction also allows for a robust system, and depending on configuration, requires only a little additional installation space.

The support surface of the swivelling lever element and the cam follower of the swivelling lever element can preferably operatively connect the rocker arm with the cam for activating the at least one gas exchange valve.

In an exemplary embodiment, the rocker arm is mounted so that it can pivot around the swivelling shaft. Additionally or alternatively, the swivelling shaft serves as a rocker arm axis for the rocker arm. Such a configuration significantly reduces the installation space of the variable valve train, since a shaft for swivelling the first rocker arm and a rocker arm axis for pivotable connection with the rocker arm need not be provided separate from each other.

In a further exemplary embodiment, turning the swivelling shaft causes the first lever arm and the swivelling lever element to pivot, making it possible to vary the transmission of the cam contour of the cam from the swivelling lever element to the rocker arm, in particular continuously. The valve lift curve transmitted to the at least one gas exchange valve can be varied by changing the position of the swivelling axis that pivotably connects the first lever arm and swivelling lever element by swivelling the first lever arm.

In a further development, the transmission for changing a maximum valve lift of the at least one gas exchange valve is variable, in particular up to a zero lift of the at least one gas exchange valve. The advantage to this is that the quantity of gas flowing through the gas exchange valve can be varied by the variable valve train, in particular going as far as blocking the quantity of gas by keeping the gas exchange valve closed, which for example can be used for cylinder deactivation.

In an embodiment variant, the first lever arm is non-rotatably connected with the swivelling shaft. The rigid connection makes it possible to impart a rotational movement of the swivelling shaft directly to the first lever arm for swivelling the latter. The first lever arm can be non-rotatably connected directly with the swivelling shaft, or non-rotatably connected indirectly with the swivelling shaft by interspersing one or several intermediate elements, for example a sleeve enveloping the swivelling shaft.

It is also possible to use another connection between the first lever arm and the swivelling shaft, which causes the first lever arm to swivel while rotating the swivelling shaft.

In another embodiment variant, the swivelling lever element is swiveled relative to the first lever arm while following the cam contour of the cam via the cam follower. Alternatively or additionally provided is a swivelling axis that pivotably joins the first lever arm and swivelling lever element together. As a consequence, the pivotable connection (swivelling axis) between the swivelling lever element and first lever arm can perform two tasks. On the one hand, it allows a swivelling of the swivelling lever element so as to follow the cam contour of the cam. On the other hand, the connection (swivelling axis) serves as a suspension for the swivelling lever element, whose position can be changed by means of the first lever arm, so as to vary the valve lift curve of the at least one gas exchange valve.

In an embodiment, the rocker arm has a rotatable roller for contacting the support surface. The rotatable roller can rest on the support surface. The support surface can have a continuous progression. The rotatable roller can enable a continuous displacement of the variable valve train.

In a further development, the cam follower of the swivelling lever element and the rotatable roller of the rocker arm can have the same design. As a result, the cam follower and the roller of the rocker arm can be configured as identical parts. This reduces the diversity of parts.

In another exemplary embodiment, the support surface has a concave design. However, the support surface can also be flat or convex. This depends on the selected lever ratios of the valve train.

In an embodiment variant, the swivelling shaft can only be turned within a limited angular range of less than 360°, in particular within an angular range of less than 120°. This can stem from the fact that the first lever arm need only be swiveled within a small angular range for swivelling the swivelling lever element so as to change the transmission of the cam contour on the rocker arm. The limited necessary angular range for turning the swivelling shaft can influence a drive unit of the swivelling shaft and a connection between the drive unit and the swivelling shaft.

The swivelling shaft can preferably be rotatably mounted in bearing blocks, which preferably are secured on a cylinder head of the internal combustion engine.

In another embodiment variant, the variable valve train has a second lever arm, which is connected with the first lever arm via the swivelling shaft, and in particular via the swivelling axis. In particular, the first lever arm and second lever arm can be arranged on opposing sides of the rocker arm. Two lever arms can allow for an especially reliable mount for the swivelling lever element. The arrangement on opposing sides of the rocker arm can be favorable for reasons of installation space.

The first lever arm can preferably be designed like the second lever arm. As a consequence, the first lever arm and second lever arm can be configured as identical parts. This reduces the diversity of parts.

In an embodiment, the variable valve train further has a sleeve, which is non-rotatably arranged on the swivelling shaft. The first lever arm and/or second lever arm is non-rotatably arranged on the sleeve. The rocker arm is arranged so that it can pivot around the sleeve. This can significantly simplify the assembly of the variable valve train, since an assembly comprised of a sleeve, lever arm(s) and rocker arm can be preassembled and then non-rotatably connected with the swivelling shaft. This can improve mountability in particular in embodiments with a plurality of variable valve trains for a plurality of cylinders of the internal combustion engine.

In another embodiment, the swivelling lever element is arranged between the rocker arm and the camshaft. This is advantageous for reasons of installation space.

In another exemplary embodiment, the variable valve train has a drive unit for turning the swivelling shaft. The drive unit is drivingly connected with the swivelling shaft. The drive unit can be connected with the swivelling shaft in such a way and/or the drive unit can be designed in such a way as to allow the swivelling shaft to turn only within a limited angular range. For example, a corresponding electric servomotor with an angular range can be used.

Alternatively, the variable valve train can have an actuator, for example, which is designed to contact the first lever arm for swivelling the first lever arm. The lever arm can be adjusted via the actuator in multiple stages (in particular two stages), for example. When using the actuator for adjusting the first lever arm, at least one actuator must be provided for each cylinder. Stops for limiting the adjustment of the first lever arm can further be provided.

In another embodiment variant, the variable valve train has a camshaft adjuster, which is connected with the camshaft for adjusting a phase of the camshaft. This makes it possible to increase a variability of the variable valve train, since in particular the valve lift curves can be shifted, i.e., the opening and closing times of the gas exchange valves or gas exchange valve can be altered.

The present disclosure can be used to special advantage in a motor vehicle, in particular a commercial vehicle (for example a bus or truck). The motor vehicle has the variable valve train as disclosed herein.

However, it is also possible to use the variable valve train in internal combustion engines that are not included in motor vehicles. For example, this can involve stationary internal combustion engines, internal combustion engines on ships or in locomotives.

The embodiments and features of the present disclosure described above can be combined with each other however desired.

BRIEF DESCRIPTION OF THE DRAWINGS

Additional details and advantages of the present disclosure will be described below with reference to the attached drawings. In the drawings.

The embodiments shown in the figures at least partially coincide, so that similar or identical parts are provided with the same reference number, and reference is also made to the description of the other embodiments or figures for describing the latter, so as to avoid repetition.

DETAILED DESCRIPTION

Figure 1:
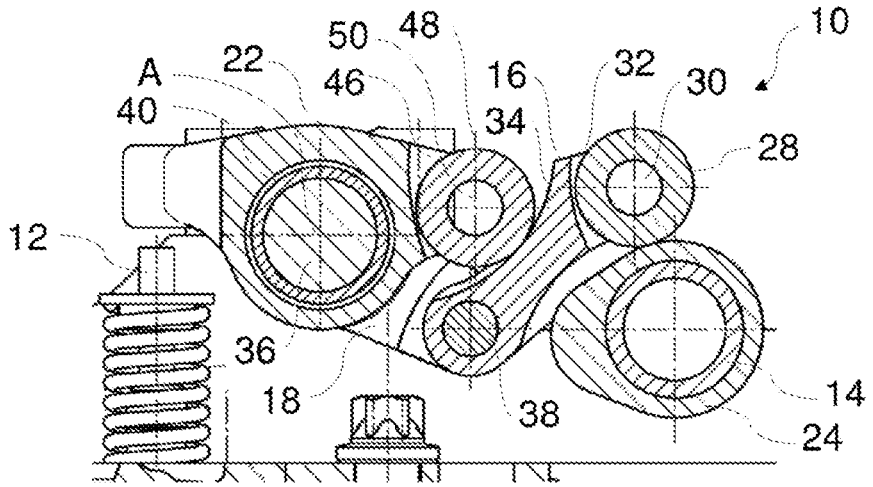
FIG. 1 shows a sectional view of an exemplary, variable valve train in a state where a cam follower of the variable valve train is in contact with a base circle area of a cam of the camshaft.
Figure 3:
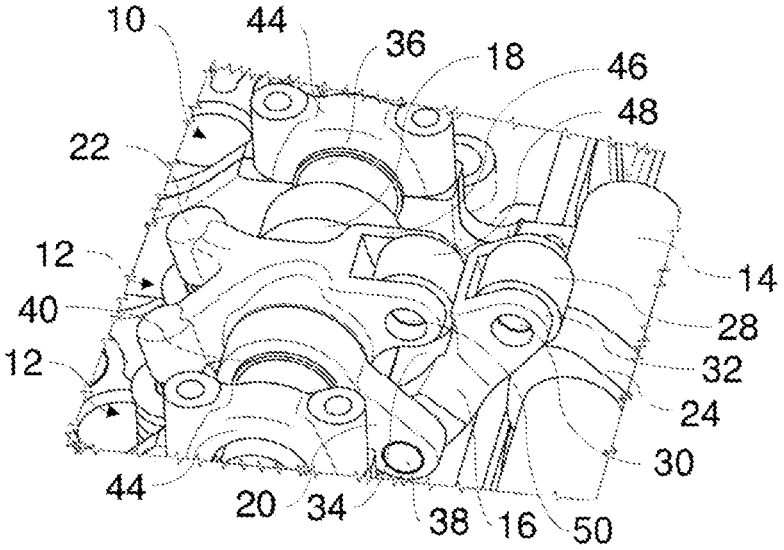
FIG. 3 shows a perspective view of the exemplary, variable valve train.
Figure 4:
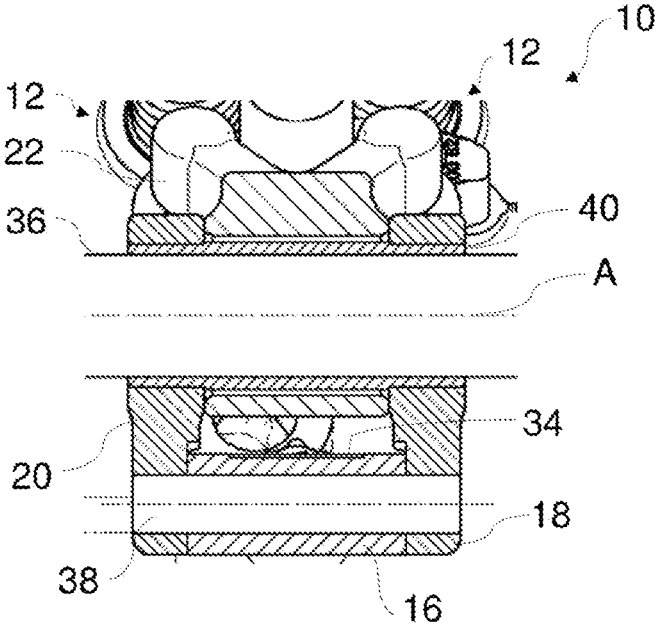
FIG. 4 shows another sectional view of the exemplary, variable valve train, with a section plane having a longitudinal axis of the swivelling shaft and a swivelling axis.

FIGS. 1 and 4 show a variable valve train 10. The variable valve train 10 activates two gas exchange valves 12 (see in particular FIG. 3), for example inlet valves or outlet valves. The variable valve train 10 can be encased in an internal combustion engine of a motor vehicle, in particular of a commercial vehicle. It is also possible for the variable valve train to activate only a gas exchange valve. It is likewise possible for the variable valve train to activate several gas exchange valves by way of a valve bridge.

The variable valve train 10 has a camshaft 14, a swivelling lever element 16, two lever arms 18 and 20 as well as a rocker arm 22.

Figure 2:
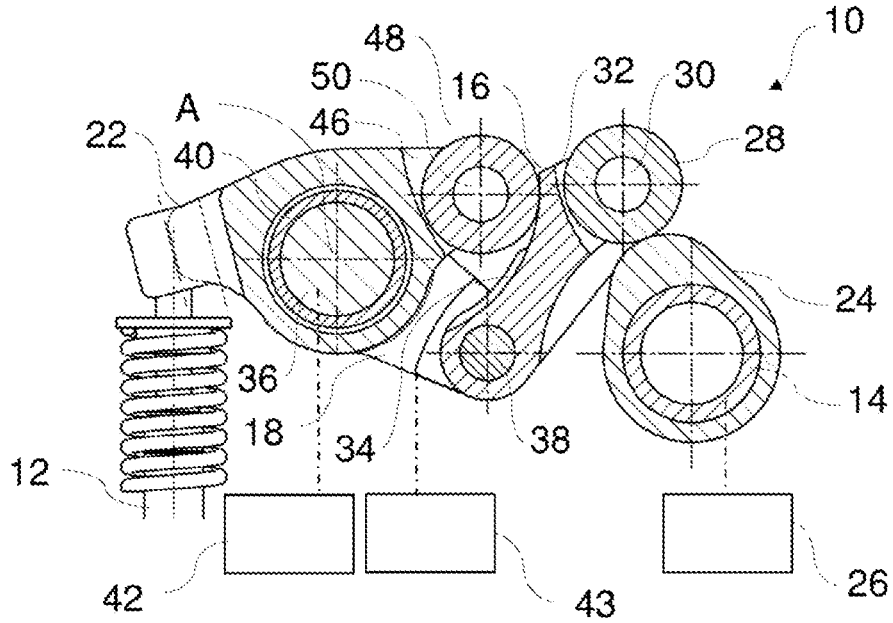
FIG. 2 shows another sectional view of the exemplary, variable valve train in a state where the cam follower of the variable valve train is in contact with a valve lift area of the cam of the camshaft.

The camshaft 14 is rotatably mounted, and has a cam 24. In several embodiments, the camshaft 14 can be connected with a camshaft adjuster 26 for adjusting a phase of the camshaft 14. The camshaft adjuster 26 is schematically indicated in FIG. 2. Specifically, the camshaft adjuster 26 can turn the camshaft 14 by a predetermined angular increment clockwise or counterclockwise relative to a drive by way of a crankshaft of the internal combustion engine. As a result, the opening and closing time for the gas exchange valves 12 can be shifted.

The swivelling lever element 16 carries a cam follower 28. The cam follower 28 follows a cam contour of the cam 24 while the camshaft 14 turns. The cam follower 28 is designed as a roller mounted so that it can rotate around a cam follower axis 30. The cam follower axis 30 is carried by a fork 32 of the swivelling lever element 16 at opposite ends of the cam follower axis 30. The fork 32 is arranged at a first end of the swivelling lever element 16.

The swivelling lever element 16 is pivotably joined with the lever arms 18, 20 at one of the ends of the swivelling lever element 16 lying opposite the fork 32. While the cam follower 28 follows the cam contour of the cam 24 while the camshaft 14 turns, the swivelling lever element 16 is swiveled relative to the lever arms 18, 20. The swivelling lever element 16 has a support surface 34. The support surface 34 serves as a contact surface for the rocker arm 22. The support surface 34 extends concavely, and is arranged on an upper side of the swivelling lever element 16. The swivelling lever element 16 thus serves as a gate for the rocker arm 22.

The lever arms 18, 20 are non-rotatably connected with a swivelling shaft 36, so that they turn together with the swivelling shaft 36. Specifically, the lever arms 18, 20 turn while the swivelling shaft 36 rotates around a longitudinal axis A of the swivelling shaft 36. The swivelling shaft 36 simultaneously serves as a rocker arm axis for the rocker arm 22. This is especially advantageous for reasons of installation space, since no separate axes must be provided for swivelling the lever arms 18, 20 and for pivotably mounting the rocker arm 22.

The lever arms 18, 20 are connected with each other via the swivelling shaft 36 and a swivelling axis 38. The lever arms 18, 20 are arranged at opposite sides of the rocker arm 22. The lever arms 18, 20 grip the swivelling lever element 16 at the end of the swivelling lever element 16 opposite the fork 32. The lever arms 18, 20 carry the swivelling lever element 16 via the swivelling axis 38, so that the swivelling lever element 16 can swivel relative to the lever arms 18, 20. The swivelling lever element 16 can here be non-rotatably connected with the swivelling axis 38, for example, wherein the swivelling axis 38 is in turn rotatably mounted in the lever arms 18, 20. Alternatively, the swivelling lever element 16 can be provided so as to swivel around the swivelling axis 38. It is also possible to provide just one lever arm, for example, which carries the swivelling lever element.

As shown in FIG. 4, the lever arms 18, 20 are connected with the swivelling shaft 36 via a sleeve 40. Specifically, the lever arms 18, 20 are non-rotatably connected with the sleeve 40, wherein the sleeve 40 in turn is non-rotatably connected with the swivelling shaft 36. For example, the non-rotatable connections can be realized with a suitable fit, through welding, adhesive bonding, bolting, interlocking, etc.

FIG. 2 presents a schematic view of a drive unit 42, for example an electric drive. The drive unit 42 is connected with the swivelling shaft 36, so that the swivelling shaft 36 can rotate at least within a prescribed angular range, for example of less than 360°, in particular less than 90°. The angular range depends on the lever arm lengths of the variable valve train 10, and can also be less than 20°, e.g., as in the example shown. Turning the swivelling shaft 36 causes the lever arms 18 and 20 to swivel, since the latter are non-rotatably connected with the swivelling shaft 36. Swivelling the lever arms 18 and 20 causes the swivelling lever element 16 to swivel. The swivelling lever element 16 here changes a position relative to the rocker arm 22 and camshaft 14. This enables a targeted influencing of a transmission of the cam contour of the cam 24 via the swivelling lever element 16 to the rocker arm 22, which ultimately activates the gas exchange valves 12, as will be described in more detail below.

An actuator 43 can also be provided as an alternative to the drive unit 42. For example, the actuator 43 can contact the first lever arm 18 and/or the second lever arm 20, so as to swivel the first and second lever arm 18, 20. Swivelling the lever arms 18, 20 in turn causes the swivelling lever element 16 to swivel, as already described above. In such an embodiment, the lever arms 18, 20 can be rotatably connected with the swivelling shaft 36, which thus only serves as a swivelling axis.

To enable a rotation of the swivelling shaft (rocker arm axis) 36, the swivelling shaft 36 is rotatably mounted in bearing blocks 44, for example via slide bearings or roller bearings (see FIG. 3). For example, the bearing blocks 44 can be fastened to a cylinder head of the internal combustion engine by means of screws (not shown).

Again drawing reference to FIG. 4, the rocker arm 22 is mounted so that it can pivot around the sleeve 40, and thus pivot around the swivelling shaft 36. An assembly of the variable valve train 10 can be simplified by providing the sleeve 40 as an intermediate element between the swivelling shaft 36 on the one hand and the lever arms 18, 20 and rocker arm 22 on the other. In particular, an assembly comprised of the lever arms 18, 20, the rocker arm 22 and sleeve 40 can first be prefabricated, wherein the lever arms 18, 20 are non-rotatably connected with the sleeve 40, and the rocker arm 22 is rotatably arranged around the sleeve 40. The sleeve 40 can then be non-rotatably connected with the swivelling shaft 36. In other embodiments, for example, the lever arms 18, 20 can be non-rotatably connected directly with the swivelling shaft 36 (i.e., without interspersing a sleeve). Alternatively or additionally, the rocker arm 22 can be pivotably connected directly with the swivelling shaft 36 (i.e., without interspersing a sleeve). It is also possible to provide other configurations in which the lever arms 18, 20 are non-rotatably connected with the swivelling shaft 36, and the rocker arm 22 is pivotably connected with the swivelling shaft 36.

The rocker arm 22 has a fork 46, which carries a rotatable roller 48 via a roller axis 50. The rotatable roller 48 is in contact with the support surface 34 of the swivelling lever element 16. The cam follower 28 of the swivelling lever element 16 and the rotatable roller 48 of the rocker arm 22 can have the same design, since they transmit roughly the same forces, and so as to reduce the diversity of parts. The rocker arm 22 activates the gas exchange valves 12, for example via a ball foot (elephant foot, not shown).

FIGS. 1 and 2 show how the variable valve train 10 establishes an operative connection between the camshaft 14 and the gas exchange valves 12 during operation. In FIG. 1, the cam follower 28 is in contact with a base circle area of the cam 24. In FIG. 2, the cam follower 28 is in contact with a valve lift area of the cam 24. Specifically, the valve lift area of the cam contour of the cam 24 causes the swivelling lever element 16 to swivel around the swivelling axis 38, since the cam follower 28 follows the cam contour of the cam 24.

Swivelling the swivelling lever element 16 around the swivelling axis 38 causes the rocker arm 22 to swivel around the swivelling shaft 36, since the roller 48 is in contact with the support surface 34. In particular, when the swivelling lever element 16 is swiveled upwardly, the ascending ramp of the cam 24 causes the roller 48 to roll upwardly on the support surface 34. The rocker arm 22 is swiveled around the swivelling shaft 36. The gas exchange valves 12 are activated (opened) while swivelling the rocker arm 22. While swivelling the swivelling lever element 16 downwardly as the result of the descending ramp of the cam 24, the roller 48 rolls downwardly on the support surface 34. The rocker arm 22 is swiveled back. By contrast, the base circle area of the cam contour of the cam 24 produces no swivelling of the swivelling lever element 16, and thus also no swivelling of the rocker arm 22.

Figure 5:
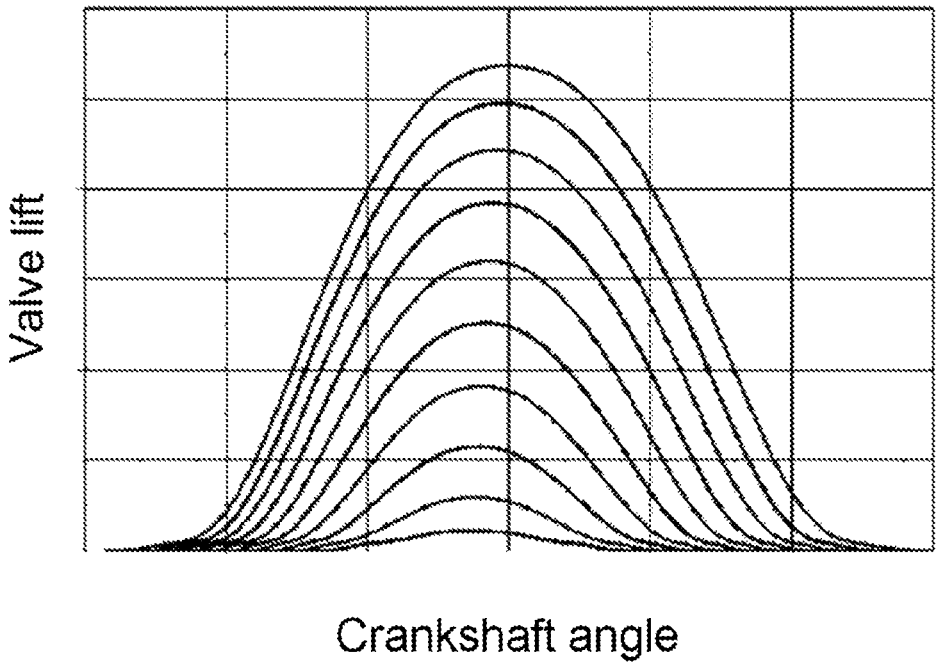
FIG. 5 shows exemplary valve lift control curves, which can be generated with the exemplary, variable valve train.

FIG. 5 shows exemplary valve lift curves for the gas exchange valves 12, which can be adjusted with the variable valve train 10. Depending on the set rotational angle of the swivelling shaft 36 and the profile of the support surface 34, various valve lifts (valve lift maximums) can be set. In particular, it can also be possible to generate a zero lift of the gas exchange valves 12. With reference to FIGS. 1 and 2, adjusting the swivelling shaft 36 clockwise increases the valve lift maximums of the gas exchange valves 12. By contrast, adjusting the swivelling shaft 36 counterclockwise reduces the valve lift maximums of the gas exchange valves 12. This effect is achieved by virtue of the fact that adjusting the swivelling shaft 36 influences the position of the swivelling axis 38 relative to the camshaft 14 and roller 48. Shifting the swivelling axis 38 alters the lever ratios between the camshaft 14 and roller 48, and thus the transmission ratio from the cam profile to the gas exchange valve 12. Shifting the swivelling axis 38 causes another gate profile section of the support surface 34 to get into the cam tap (come into contact with the roller 48). This ultimately makes it possible to influence the valve lift height.

The support surface 34 of the swivelling lever element 16 is to be specially designed for achieving the valve lift curves depicted in FIG. 5. The exemplarily concave progression of the support surface 34 must be designed in such a way that the valve lift maximums of the valve lift curves can be influenced as desired by adjusting the lever arms 18. For example, the support surface 34 must be configured as a function of the arrangement and dimensions of the camshaft 14, cam 24, cam follower 28, swivelling lever element 16, first lever arm 18, second lever arm 20, roller 48, rocker arm 22, swivelling shaft 36, swivelling axis 38 and gas exchange valves 12.

In combination with the camshaft adjuster 26, the valve lift curves can also be shifted (along the abscissa in FIG. 5), so that the opening and closing times can be varied.

The present disclosure is not limited to the exemplary embodiments described above. Rather, a plurality of variants and modifications is possible, which also make use of the concepts and ideas, and thus fall within the protective scope. In particular, the present disclosure is also directed to the presence and design of the support surface, swivelling shaft and/or pivotable connection between the first lever arm and swivelling lever element.

LIST OF REFERENCE SIGNS

10 Variable valve train
12 Gas exchange valve
14 Camshaft
16 Swivelling lever element
18 First lever arm
20 Second lever arm
22 Rocker arm
24 Cam
26 Camshaft adjuster
28 Cam follower
30 Cam follower axis
32 Fork
34 Support surface
36 Swivelling shaft
38 Swivelling axis
40 Sleeve
42 Drive unit
43 Actuator
44 Bearing block
46 Fork
48 Roller
50 Roller axis
A Longitudinal axis

I claim:

1. A variable valve train for an internal combustion engine, the variable valve train comprising:

a camshaft with a cam;

a center pivot rocker arm including a first end configured to activate at least one gas exchange valve of the internal combustion engine, a swivelling lever element which has a support surface and a cam follower, wherein the support surface is operatively connected with a second end of the rocker arm, and the cam follower follows a cam contour of the cam; and a first lever arm, which pivotally mounts to the swivelling lever element, and is connected with a driven swivelling shaft configured to swivel around a longitudinal axis of the swivelling shaft.

2. The variable valve train according to claim 1, wherein the swivelling lever element is a swivelling lever gate.

3. The variable valve train according to claim 1, wherein the support surface is in contact with the second end of the rocker arm.

4. The variable valve train according to claim 1, wherein:

the rocker arm is mounted so that the rocker arm pivots around the swivelling shaft; or the swivelling shaft serves as a rocker arm axis for the rocker arm.

5. The variable valve train according to claim 1, wherein turning the swivelling shaft causes the first lever arm and the swivelling lever element to pivot so as to vary a transmission of the cam contour of the cam from the swivelling lever element to the rocker arm.

6. The variable valve train according to claim 5, wherein the transmission of the cam contour of the cam from the swivelling lever element to the rocker arm is continuously variable.

7. The variable valve train according to claim 5, wherein a transmission for changing a maximum valve lift of the at least one gas exchange valve is variable.

8. The variable valve train according to claim 7, wherein the transmission for changing the maximum valve lift of the at least one gas exchange valve is variable up to a zero lift of the at least one gas exchange valve.

9. The variable valve train according to claim 1, wherein the first lever arm is non-rotatably connected with the swivelling shaft.

10. The variable valve train according to claim 1, wherein:

the swivelling lever element is swiveled relative to the first lever arm while following the cam contour of the cam via the cam follower; or a swivelling axis pivotally joins the first lever arm and swivelling lever element together.

11. The variable valve train according to claim 1, wherein the second end of the rocker arm has a rotatable roller configured to contact the support surface.

12. The variable valve train according to claim 11, wherein the cam follower of the swivelling lever element and the rotatable roller of the rocker arm have a same design.

13. The variable valve train according to claim 1, wherein the swivelling shaft turns only within a limited angular range of less than 360°.

14. The variable valve train according to claim 13, wherein the limited angular range is less than 120°.

15. The variable valve train according to claim 1, further comprising:

a second lever arm connected with the first lever arm via the swivelling shaft, wherein the first lever arm and second lever arm are arranged on opposing sides of the rocker arm.

16. The variable valve train according to claim 15, wherein the second lever arm is further connected to the first lever arm via a swivelling axis.

17. The variable valve train according to claim 1, further comprising:

a sleeve non-rotatably arranged on the swivelling shaft, wherein the first lever arm is non-rotatably arranged on the sleeve, and the rocker arm is arrange to pivot around the sleeve.

18. The variable valve train according to claim 1, wherein the swivelling lever element is arranged between the second end of the rocker arm and the camshaft.

19. The variable valve train according to claim 1, further comprising:

a drive unit for turning the swivelling shaft; or an actuator contacting the first lever arm, the actuator configured to swivel the first lever arm.

20. The variable valve train according to claim 1, further comprising:

a camshaft adjuster connected with the camshaft, the camshaft adjuster configured to adjust a phase of the camshaft.

21. A motor vehicle, comprising:

a variable valve train including, a camshaft with a cam;

a center pivot rocker arm including a first end configured to activate at least one gas exchange valve of the internal combustion engine;

a swivelling lever element which has a support surface and a cam follower, wherein the support surface is operatively connected with a second end of the rocker arm, and the cam follower follows a cam contour of the cam; and a first lever arm, which pivotally mounts to the swivelling lever element, is connected with a driven swivelling shaft configured to swivel around a longitudinal axis of the swivelling shaft.

* * * * *